US006405416B1

(12) United States Patent
Fleissner

(10) Patent No.: US 6,405,416 B1
(45) Date of Patent: Jun. 18, 2002

(54) METHOD AND DEVICE FOR PRODUCING PERFORATED NONWOVENS BY HYDRODYNAMIC NEEDLING

(76) Inventor: Gerold Fleissner, Bahnhofstr. 2, CH-6300 Zug (CH)

( * ) Notice: Subject to any disclaimer, the term of this patent is extended or adjusted under 35 U.S.C. 154(b) by 0 days.

(21) Appl. No.: 10/022,379

(22) Filed: Dec. 20, 2001

Related U.S. Application Data

(62) Division of application No. 09/528,179, filed on Mar. 17, 2000, now Pat. No. 6,338,187.

(30) Foreign Application Priority Data

Mar. 22, 1999 (DE) ..... 199 12 905

(51) Int. Cl.[7] ..... D04H 1/40; D06C 9/02
(52) U.S. Cl. ..... 28/106; 28/104; 26/3
(58) Field of Search ..... 28/104, 105, 106, 28/170, 171, 167, 163, 103; 26/3, 4, 5, 6, 69 R, 69 B

(56) References Cited

U.S. PATENT DOCUMENTS

| | | | | |
|---|---|---|---|---|
| 373,857 A | | 11/1887 | Sayles et al. | |
| 3,014,263 A | | 12/1961 | Oace | |
| 3,081,500 A | | 3/1963 | Griswold et al. | |
| 3,096,557 A | * | 7/1963 | Messinger | 28/167 |
| 3,113,349 A | | 12/1963 | Nottebohm et al. | |
| 3,134,158 A | | 5/1964 | Marks | |
| 3,395,430 A | | 8/1968 | Randle | |
| 3,681,184 A | | 8/1972 | Kalwaites | |
| 3,800,364 A | | 4/1974 | Kalwaites | |
| 3,874,958 A | | 4/1975 | Scholtis et al. | |
| 4,125,921 A | | 11/1978 | Okazaki et al. | |
| 4,868,958 A | | 9/1989 | Suzuki et al. | |
| 5,098,764 A | | 3/1992 | Drelich et al. | |
| 5,414,914 A | | 5/1995 | Suzuki et al. | |
| 5,632,072 A | | 5/1997 | Simon et al. | |
| 5,737,813 A | | 4/1998 | Sternlieb et al. | |
| 6,270,623 B1 | * | 8/2001 | Goda et al. | 28/104 |

FOREIGN PATENT DOCUMENTS

| | | |
|---|---|---|
| DE | 19819641 | 1/1999 |
| FR | 2475460 | 8/1981 |
| GB | 1358479 | 7/1974 |
| GB | 2322642 | 9/1998 |

* cited by examiner

*Primary Examiner*—Amy B. Vanatta
(74) *Attorney, Agent, or Firm*—Antonelli, Terry, Stout & Kraus, LLP

(57) ABSTRACT

Method and device for producing perforated nonwovens by hydrodynamic needling. A nonwoven with a basically clean hole structure on a drum with plastic elevations can be produced by energy-rich water jets. Depending on the thickness of the fibers used in the nonwoven, however, certain fibers can nevertheless be stretched transversely across a hole. In order to avoid or eliminate this, the perforated nonwoven is subjected to singeing flames after drying.

6 Claims, 1 Drawing Sheet

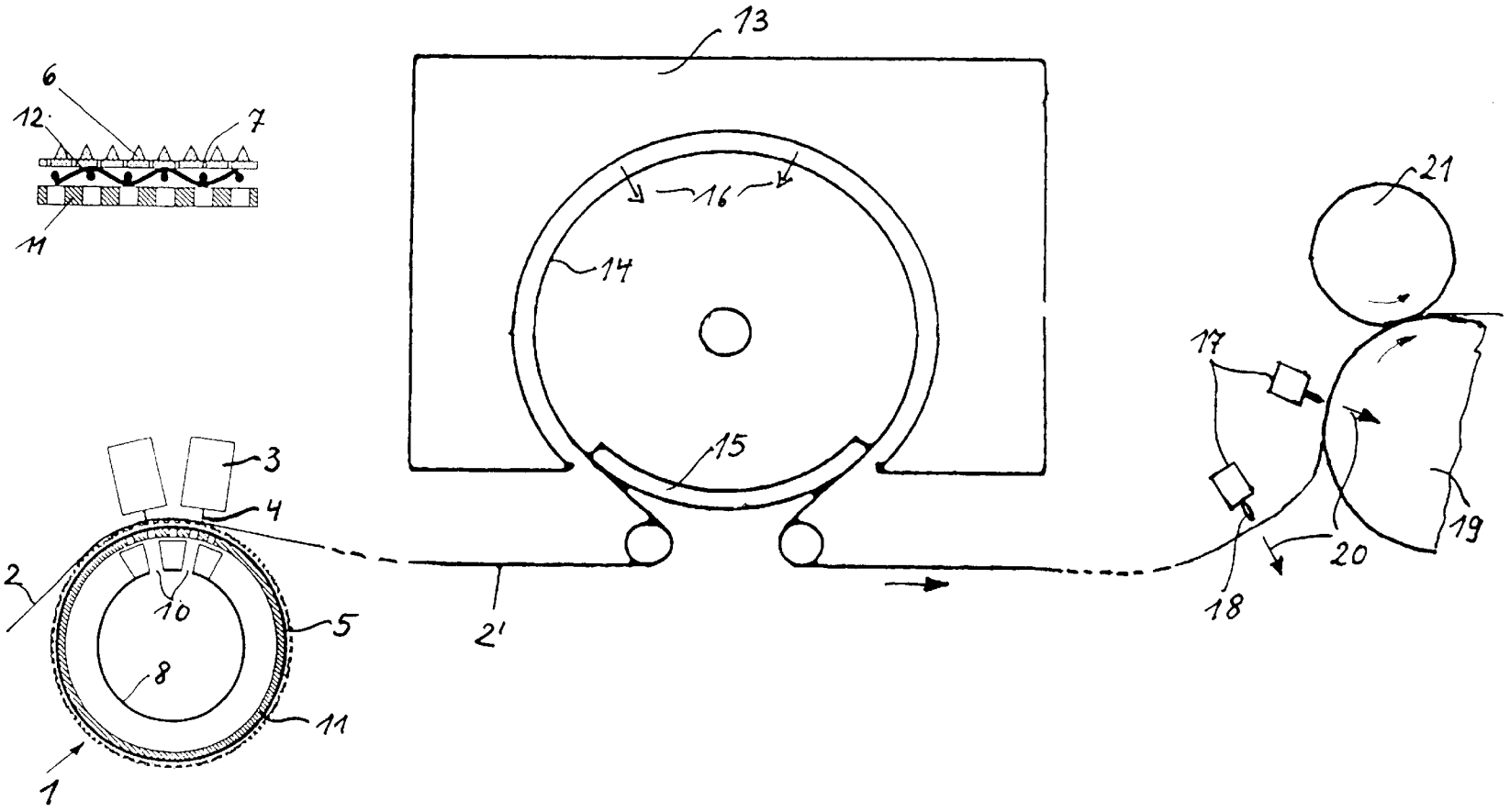
21
19
20
17
18
13
16
15
14
2'
7
6
12
11
3
4
5
11
10
8
2
1

METHOD AND DEVICE FOR PRODUCING PERFORATED NONWOVENS BY HYDRODYNAMIC NEEDLING

This is a divisional application of U.S. Ser. No. 09/528,179, filed Mar. 17, 2000 now U.S. Pat. No. 6,338,187.

BACKGROUND OF THE INVENTION

The invention relates to a method for continuous production of a nonwoven provided with holes in which the unperforated nonwoven is subjected to a hydrodynamic needling in which the holes are produced by compression of fibers and the nonwoven is then subjected to an at least partial drying.

Hole patterns can be produced in accordance with U.S. Pat. No. 3,750,237. Then the prefabricated nonwoven, held between two endless webs, is struck radially from the outside by hard water jets to produce a hole structure. The device consists of a uniformly perforated drum covered all the way around by an endless screen. The endless screen has open and closed areas depending on the desired hole structure. The disadvantage of this method of producing the holes is the fact that no holes with sharply delimited edges can be produced in this fashion and in addition individual nonwoven fibers are displaced toward the drum by the hard water jets as the holes are produced.

Sharply delimited holes can be produced subsequently in a prefabricated uniform nonwoven using the manufacturing methods according to EP-A-0 215 684, 0223 614, or 0273454. In each case, a perforated drum made of smooth sheet metal is produced with drainage openings on which plastic elevations uniformly distributed over the surface between the openings are formed. The plastic elevations can consist of beads open. half way so that the drainage openings are formed at the same time or even better from uniformly distributed mandrels tapering upward to a point between which holes are made in the sheet metal as drainage openings. The water jets strike this drum surrounded by the nonwoven radially from the outside. In all cases, the drum is made of a metal sheet to which the mandrels or other plastic elevations can simply be screwed; see also U.S. Pat. No. 3,034,180.

Practice has shown that depending on the fibers used for the nonwoven, holes with clean edges can be produced with difficulty in a previously uniform nonwoven, holes that have no fibers stretched across the hole-like openings in the nonwoven.

SUMMARY OF THE INVENTION

The goal of the invention is to provide a method and an advantageous device for working this method with which this dean hole edge structure can be produced in a water-needled nonwoven.

On the basis o f the conventional method for hydrodynamic needling of a nonwoven on a drum with plastic elevations thereon, the invention provides as the solution to the problem that the nonwoven provided with holes is subjected to singeing flames or subsequent destruction of any transversely stretched individual fibers still present over the cross section of the holes. If stiffer fibers are to be contained in the non woven, which can be displaced at least not permanently into the marginal areas of the respective holes by the water needling on a perforated drum, these fibers, namely only the ones that are stretched across the holes, are subjected briefly to melting. Ends of these individual fibers separated by melting retract automatically into the marginal areas of the holes so that neater holes can be produced continuously in this fashion by using water needling.

It is advisable to cool the nonwoven during singeing, or rather directly afterward, so that other fibers in the nonwoven will not be heated unnecessarily, It can also be advantageous to allow the flames of the singeing device to pass through the previously formed holes. For this purpose, the nonwoven to be singed does not have to rest on the substrate but can be guided hanging freely and then cooled again immediately afterward. One can also think of subjecting the flames on the opposite side of the nonwoven to suction so that they reliably act through the holes to melt the fibers held stretched there.

BRIEF DESCRIPTION OF THE DRAWINGS

A device of the type according to the invention is shown in the drawing for example. The FIGURE shows in cross section a plurality of devices in a system for water needling of a nonwoven to produce holes, with a dryer and a singeing device at the end of the system.

DETAILED DESCRIPTION OF THE PREFERRED EMBODIMENTS

In the drawing, only one drum 1 for water needling is shown, followed by other peripheral parts which have been omitted for the sake of visibility. The basically finished nonwoven 2 runs directly over drum 1 with which one or more nozzle beams 3 are directly associated externally. Each nozzle beam 3 is arranged axially parallel to drum 1 and is provided on its underside facing drum I with a nozzle strip not shown here to allow water jets 4 to escape.

Drum 1 consists of a drum wall 5 made thin and unstable. This drum wall 5 (according to the cross section shown above enlarged) has on the outside a plurality of plastic elevations such as mandrels 6. Mandrels 6 are surrounded by drainage openings 7. Such an unstable sheath in a working width of any length is then pulled onto a stable screen drum 11 to which a coarse screen fabric 12 has already been applied to provide a space between wall 5 and screen drum 11. As a result, the unstable wall 5 is secured firmly and immovably all the way around and in the radial direction as well. As usual, screen drum 11 is used to draw off the water applied by spraying under a vacuum, for which purpose suction tube 8 is located centrally inside drum 1 which has a suction slot 10 extending toward screen drum 1 with which water beams 3 are also associated.

The nonwoven 2' on this drum 1 and provided with holes then tapers downstream from a dryer for which purpose a ventilator 13 is provided as shown in the drawing with a screen drum 14 under vacuum 16. In the area that is not surrounded by nonwoven 2', screen drum 14 is protected from suction 16 by an inner panel 15.

Following the drying process, perforated nonwoven must be singed in the holes. For this purpose, a singeing device is shown purely schematically in the drawing. It consists of a beam 17 extending over the working width by which flames 18 can be directed against the nonwoven. In addition, a drum 19 is shown in the singeing device which is intended primarily for cooling but also for transporting the nonwoven. Flames 18 can be directed at drum 19 or in the area in front of drum 19, onto the nonwoven so that in the area of the nonwoven which is not guided, the flames can penetrate the holes better. It is possible also to have suction 20 to which the flames are subjected.

Cooling and transport drum 19 can also have an opposing drum 21 associated with it that can likewise be cooled for cooling the other side of the nonwoven.

What is claimed is:

1. System for the continuous production of a nonwoven provided with holes, comprising:

a water jet needling device to produce holes in a nonwoven by compressing the fibers into the lateral areas of the individual holes;

a drying device for at least partially drying the nonwoven wet by the water jet needling device; and a singeing device extending over the working width of the nonwoven, the singeing device aiming open flames directly against the nonwoven.

2. System according to claim 1, characterized in that the singeing device comprises a drum associated with a singeing beam emitting the open flames, the drum being provided for transporting the nonwoven.

3. System according to claim 2, characterized in that the drum is cooled.

4. System according to claim 2, characterized in that the drum is associated with an additional cooling roller, between which the nonwoven is moved for cooling on both sides.

5. System according to claim 2, characterized in that a singeing beam is provided directly in front of the drum to direct flames against the unsupported nonwoven.

6. System according to claim 1, characterized in that the singeing device is associated on the opposite side of the nonwoven with a device for producing suction.

* * * * *